US012616344B2

(12) United States Patent
LeMahieu et al.

(10) Patent No.: US 12,616,344 B2
(45) Date of Patent: May 5, 2026

(54) TOILET SEAT HINGE

(71) Applicant: Bemis Manufacturing Company, Sheboygan Falls, WI (US)

(72) Inventors: Brian LeMahieu, Sheboygan, WI (US); Jeffrey J. Weiss, Sheboygan, WI (US)

(73) Assignee: Bemis Manufacturing Company, Sheboygan Falls, WI (US)

( * ) Notice: Subject to any disclaimer, the term of this patent is extended or adjusted under 35 U.S.C. 154(b) by 439 days.

(21) Appl. No.: 18/093,367

(22) Filed: Jan. 5, 2023

(65) Prior Publication Data

US 2023/0218129 A1 Jul. 13, 2023

Related U.S. Application Data

(60) Provisional application No. 63/297,495, filed on Jan. 7, 2022.

(51) Int. Cl.
*A47K 13/12* (2006.01)

(52) U.S. Cl.
CPC ..... *A47K 13/12* (2013.01)

(58) Field of Classification Search
CPC ..... A47K 13/12
See application file for complete search history.

(56) References Cited

U.S. PATENT DOCUMENTS

| | | | | |
|---|---|---|---|---|
| 1,882,274 A | | 10/1932 | Campus | |
| D136,323 S | | 9/1943 | Watson | |
| 2,447,169 A | | 8/1948 | De Sousa | |
| 3,261,029 A | | 7/1966 | Beneke, Jr. | |
| 3,506,983 A | * | 4/1970 | Coggins | A47K 13/12 4/236 |
| 3,590,401 A | | 7/1971 | Brown | |
| D237,969 S | | 12/1975 | Firdmann | |
| 4,133,061 A | | 1/1979 | Hurd | |
| D261,800 S | | 11/1981 | Deconinck | |
| 4,319,365 A | * | 3/1982 | Bemis | A47K 13/26 4/240 |
| D291,348 S | | 8/1987 | Harrison | |

(Continued)

FOREIGN PATENT DOCUMENTS

| | | |
|---|---|---|
| CN | 104161482 A | 11/2014 |
| CN | 104244789 A | 12/2014 |

(Continued)

OTHER PUBLICATIONS

International Preliminary Report on Patentability for Application No. PCT/US2023/010164 dated Jun. 20, 2024 (9 pages).

(Continued)

*Primary Examiner* — Christine J Skubinna
(74) *Attorney, Agent, or Firm* — Michael Best & Friedrich LLP

(57) ABSTRACT

A hinge assembly is configured to pivotably couple a toilet seat to a toilet bowl about a pivot axis. The hinge assembly includes a base configured to be selectively fixed to the toilet bowl, and a post coupled to the base. The base includes a top portion, and a bottom portion opposite the top portion. The bottom portion having a skirt that is configured to abut against the toilet bowl when the base is fixed to the toilet bowl to inhibit liquid from entering between the base and the toilet bowl. The post is configured to support the toilet seat for rotation about the pivot axis.

20 Claims, 11 Drawing Sheets

(56) References Cited

U.S. PATENT DOCUMENTS

| | | | | |
|---|---|---|---|---|
| 4,729,134 | A | 3/1988 | Hillebrand et al. | |
| 5,193,228 | A | 3/1993 | Murasawa et al. | |
| D342,566 | S | 12/1993 | Adamowski et al. | |
| D363,166 | S | 10/1995 | Perrine | |
| 5,933,875 | A | 8/1999 | Hulsebus et al. | |
| 6,070,295 | A | 6/2000 | Hulsebus | |
| 6,243,884 | B1 | 6/2001 | Simonson | |
| 6,263,516 | B1 * | 7/2001 | Pedersen | A47K 13/26 4/236 |
| 6,381,762 | B1 | 5/2002 | Moser | |
| D472,621 | S | 4/2003 | Jamshasb | |
| D525,856 | S | 8/2006 | Kwan | |
| D534,256 | S | 12/2006 | Lomeli | |
| 7,203,975 | B2 | 4/2007 | Vierkant, III | |
| D558,316 | S | 12/2007 | Pontipiedra | |
| 7,389,549 | B2 | 6/2008 | Vierkant, III | |
| 7,647,652 | B1 | 1/2010 | Baker | |
| 8,122,523 | B2 | 2/2012 | Li | |
| 8,205,274 | B2 | 6/2012 | Lin et al. | |
| 8,214,931 | B2 | 7/2012 | Bemis et al. | |
| 8,214,932 | B2 | 7/2012 | Shannon | |
| 8,763,168 | B2 | 7/2014 | Zhou | |
| 8,943,618 | B2 | 2/2015 | Dundas et al. | |
| 9,107,548 | B2 | 8/2015 | Hand et al. | |
| 9,635,987 | B2 | 5/2017 | Hand et al. | |
| D809,637 | S | 2/2018 | Yamashita et al. | |
| 9,976,293 | B2 | 5/2018 | Bickerstaffe et al. | |
| 9,986,878 | B2 | 6/2018 | Stelter et al. | |
| 10,064,524 | B2 | 9/2018 | Eilmus et al. | |
| 10,106,969 | B2 | 10/2018 | Halloran et al. | |
| 10,125,894 | B2 | 11/2018 | Ji et al. | |
| 10,188,246 | B1 | 1/2019 | Ciotic | |
| 10,194,777 | B2 | 2/2019 | Laundre | |
| 10,299,639 | B2 | 5/2019 | Stevenson et al. | |
| D850,965 | S | 6/2019 | Laurans et al. | |
| D853,540 | S | 7/2019 | Snyder | |
| 10,337,223 | B2 | 7/2019 | Murphy | |
| 10,352,031 | B2 | 7/2019 | Muellenbach | |
| 10,414,540 | B2 | 9/2019 | Meicher et al. | |
| 10,448,762 | B2 | 10/2019 | Murphy et al. | |
| 10,450,733 | B2 | 10/2019 | Luettgen et al. | |
| 10,463,209 | B1 | 11/2019 | Laundre | |
| 10,487,490 | B2 | 11/2019 | Laundre et al. | |
| 10,544,574 | B2 | 1/2020 | Kuru et al. | |
| 10,575,685 | B2 | 3/2020 | Szemetylo et al. | |
| 10,582,817 | B2 | 3/2020 | Laundre | |
| 10,610,068 | B2 | 4/2020 | Laundre et al. | |
| 10,610,069 | B2 | 4/2020 | Laundre | |
| 10,612,223 | B2 | 4/2020 | Moore | |
| 10,663,938 | B2 | 5/2020 | Rexach et al. | |
| D894,352 | S | 8/2020 | Lee et al. | |
| 10,738,448 | B2 | 8/2020 | Swart et al. | |
| 10,745,898 | B2 | 8/2020 | Halloran et al. | |
| 10,851,532 | B2 | 12/2020 | Denzin et al. | |
| 10,887,125 | B2 | 1/2021 | Rexach et al. | |
| 10,912,431 | B2 | 2/2021 | Grin et al. | |
| 11,202,537 | B1 | 12/2021 | Wang | |
| 11,732,456 | B2 | 8/2023 | Griffith | |
| D1,022,164 | S | 4/2024 | Li | |
| D1,029,613 | S | 6/2024 | Chen | |
| 2004/0064876 | A1 | 4/2004 | Lu | |
| 2006/0064808 | A1 | 3/2006 | Vierkant, III | |
| 2006/0156458 | A1 | 7/2006 | Myers | |
| 2006/0218710 | A1 | 10/2006 | Furukawa et al. | |
| 2007/0017013 | A1 | 1/2007 | Pronovost | |
| 2007/0250996 | A1 | 11/2007 | Li | |
| 2008/0271230 | A1 | 11/2008 | Laundre | |
| 2010/0223718 | A1 | 9/2010 | Andersen | |
| 2011/0067170 | A1 | 3/2011 | Greenspon | |
| 2013/0067647 | A1 | 3/2013 | Stelter et al. | |
| 2016/0037982 | A1 * | 2/2016 | Zhou | A47K 13/26 4/240 |
| 2017/0058500 | A1 | 3/2017 | Garrels et al. | |
| 2018/0042434 | A1 | 2/2018 | Fielding, Jr. | |
| 2018/0064300 | A1 | 3/2018 | Chen et al. | |
| 2019/0045984 | A1 | 2/2019 | Murphy | |
| 2019/0086890 | A1 | 3/2019 | Bradley et al. | |
| 2019/0087510 | A1 | 3/2019 | Rexach et al. | |
| 2019/0120809 | A1 | 4/2019 | Rexach et al. | |
| 2019/0146438 | A1 | 5/2019 | Rexach et al. | |
| 2019/0257065 | A1 | 8/2019 | Schibur et al. | |
| 2019/0313863 | A1 | 10/2019 | Laundre | |
| 2019/0323222 | A1 | 10/2019 | Muellenbach | |
| 2019/0335963 | A1 * | 11/2019 | Delaney | A47K 13/26 |
| 2019/0373152 | A1 | 12/2019 | Tan et al. | |
| 2020/0002930 | A1 | 1/2020 | Luettgen et al. | |
| 2020/0107681 | A1 | 4/2020 | Laundre | |
| 2020/0157792 | A1 | 5/2020 | Kuru et al. | |
| 2020/0187723 | A1 | 6/2020 | Szemetylo et al. | |
| 2020/0224399 | A1 | 7/2020 | Garrels et al. | |
| 2020/0253432 | A1 | 8/2020 | Slothower et al. | |
| 2020/0407962 | A1 | 12/2020 | Luettgen et al. | |
| 2021/0054608 | A1 | 2/2021 | Denzin et al. | |
| 2021/0106191 | A1 | 4/2021 | Chung et al. | |
| 2021/0321838 | A1 | 10/2021 | Slothower et al. | |
| 2021/0378464 | A1 | 12/2021 | Laundre | |
| 2023/0218129 | A1 | 7/2023 | Lemahieu et al. | |

FOREIGN PATENT DOCUMENTS

| | | | |
|---|---|---|---|
| EP | 2189092 | A1 | 5/2010 |
| FR | 2297026 | A1 | 8/1976 |
| JP | 2006271568 | A | 10/2006 |
| WO | 2008136914 | A2 | 11/2008 |

OTHER PUBLICATIONS

Cabinet mounting plate for Aventos HK-XS, posted Mar. 15, 2017, https://www.richelieu.com/us/en/category/hinges-slides-and-opening-systems/opening-systems/1037042.

Kohler, "Kohler Replacement Hinge Assembly," <https://www.build.com/product/summary/57530?uid=1845618&jmtest=gg-gbav2_1845618&inv2=1&&source=gg-gba-pla_1845618!c6970301186!a77305318222!dc!hg&gclid=EAlalQobChMIrLDF37L19QIVshbUAR3S6wDkEAKYCSABEgLPYvD_BwE&gclsrc=aw.ds> web page visited Feb. 10, 2022.

Kohler, "K-1109093-0 Hinge Assembly," <https://www.us.kohler.com/us//productDetail/servicepasrt:621237/621237.htm> web page visited Feb. 10, 2022.

International Search Report and Written Opinion for Application No. PCT/US2023/010164 dated Jun. 23, 2023 (13 pages).

European Patent Office Extended Search Report for Application No. 23737573.8 daated Oct. 16, 2025 (9 pages).

European Patent Office Action for Application No. 23737573.8 dated Nov. 11, 2025 (1 page).

Japanese Design Registration 2017017490 (John J. Todd, Jr.), Jul. 9, 2018. [online] [retrieved on Dec. 3, 2025]. Retrieved from DesignVision (Year: 2018).

Chinese Patent Office Search Report for Application No. 202380016111.9 daterd Jan. 21, 2026 (17 pages including English machine translation).

* cited by examiner

TOILET SEAT HINGE

CROSS-REFERENCE TO RELATED APPLICATIONS

This application claims the benefit of U.S. Provisional Patent Application No. 63/297,495, filed on Jan. 7, 2022, the entire contents of which are incorporated by reference herein.

FIELD OF THE DISCLOSURE

The present disclosure relates to a toilet seat hinge.

SUMMARY

In one aspect, a hinge assembly is configured to pivotably couple a toilet seat to a toilet bowl about a pivot axis. The hinge assembly includes a base configured to be selectively fixed to the toilet bowl, and a post coupled to the base. The base includes a top portion, and a bottom portion opposite the top portion. The bottom portion having a skirt that is configured to abut against the toilet bowl when the base is fixed to the toilet bowl to inhibit liquid from entering between the base and the toilet bowl. The post is configured to support the toilet seat for rotation about the pivot axis.

In another aspect, a hinge assembly is configured to pivotably couple a toilet seat to a toilet bowl about a pivot axis. The hinge assembly includes a base configured to be selectively fixed to the toilet bowl, a post coupled to the base, and a toilet seat leaf pivotably coupled to the post about the pivot axis. The toilet seat leaf is configured to be attached to the toilet seat. The toilet seat leaf having a skirt that is configured to engage the toilet seat to inhibit liquid from entering between the toilet seat leaf and the toilet seat.

In yet another aspect, a hinge assembly is configured to pivotably couple a toilet seat to a toilet bowl about a pivot axis. The hinge assembly includes a base configured to be selectively fixed to the toilet bowl, a post coupled to the base and including a post ring, and a toilet seat leaf including a body configured to be coupled to the toilet seat and a knuckle coupled to the post for rotation about the pivot axis. An axial overlap is formed between the post ring and the knuckle in a direction parallel to the pivot axis.

Other aspects of the disclosure will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Terms of degree, such as "substantially," "about," "approximately," etc. are understood by those of ordinary skill to refer to reasonable ranges outside of the given value, for example, general tolerances associated with manufacturing, assembly, and use of the described embodiments.

Figure 1:
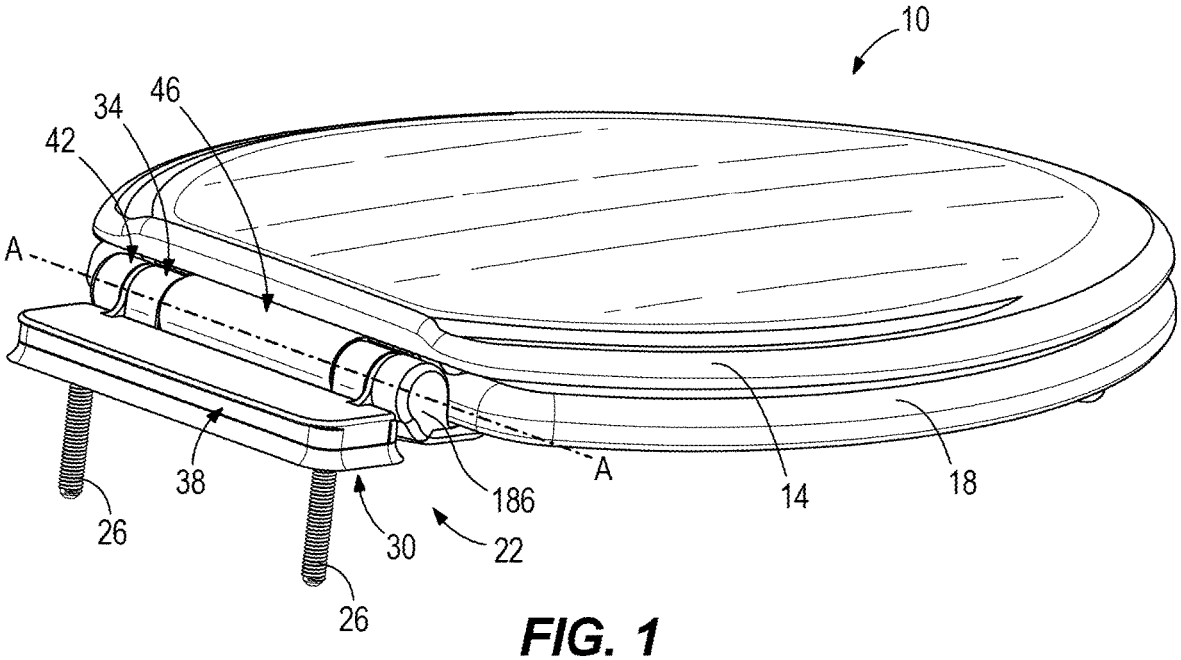
FIG. 1 is a top perspective view of a toilet seat assembly including a toilet seat hinge embodying an embodiment of the disclosure.
Figure 2:
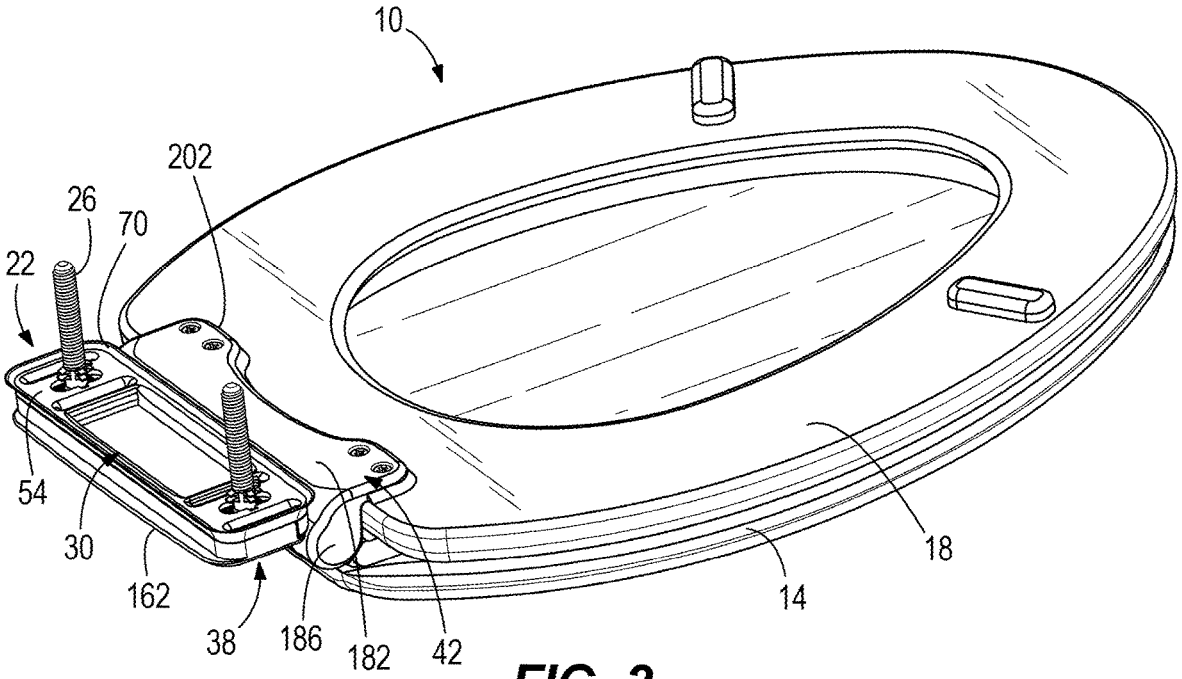
FIG. 2 is a bottom perspective view of the toilet seat assembly shown in FIG. 1.

FIGS. 1 and 2 illustrate a toilet seat assembly 10 that is mountable to a toilet bowl (not shown). The toilet seat assembly 10 includes a toilet seat cover 14, a toilet seat 18, and a toilet seat hinge 22. The toilet seat hinge 22 (FIG. 3) pivotably couples the cover 14 and the seat 18 to the toilet bowl about a pivot axis A. In the illustrated embodiment, the hinge 22 is a platform-style hinge including a portion which is fixed to the toilet bowl via two fasteners 26 that extend through the toilet bowl. In other embodiments, the hinge 22 can include two separate portions each selectively fixed to the toilet bowl by one fastener 26 or one mounting post (e.g., such a construction is disclosed within U.S. Pat. No. 9,986,878, the contents of which are incorporated herein by reference). With continued reference to FIGS. 1 and 2, the hinge 22 includes a base 30 that abuts and is fixed to the toilet bowl via the fasteners 26, a post 34 selectively coupled to the base 30, a cap 38 pivotably coupled to the post 34 about the pivot axis A, a toilet seat leaf 42 pivotably coupled to the post 34 about the pivot axis A, and a toilet cover leaf 46 (FIG. 3) also pivotably coupled to the post 34 about the pivot axis A.

Figure 4:
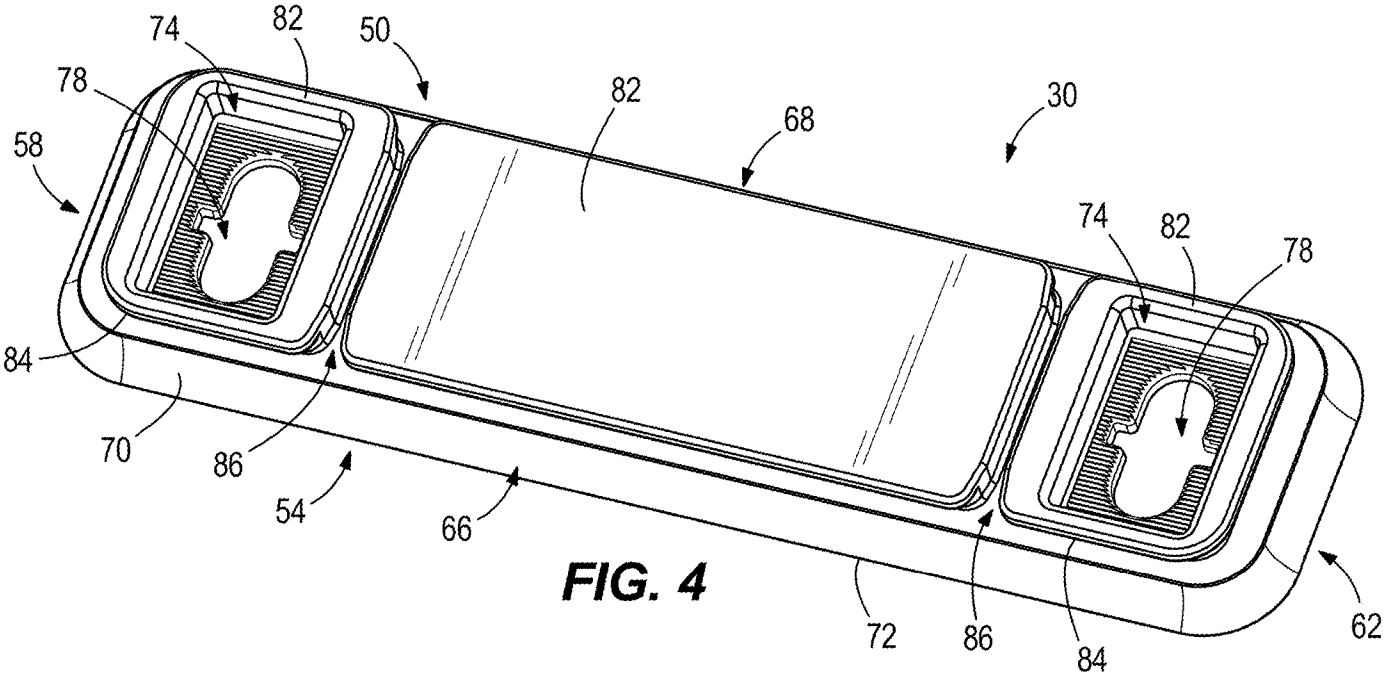
FIG. 4 is a top perspective view of a base of the toilet seat hinge shown in FIG. 1.
Figure 5:
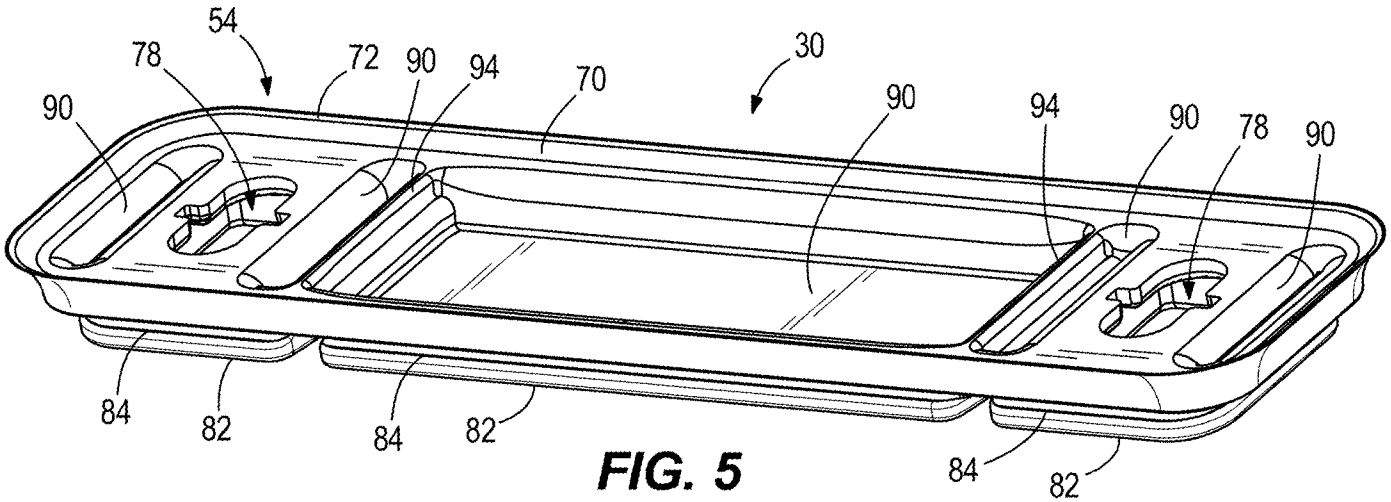
FIG. 5 is a bottom perspective view of the base shown in FIG. 4.

With reference to FIGS. 4 and 5, the base 30 includes a top portion 50 (e.g., a top surface) and a bottom portion 54 opposite the top portion 50. The bottom portion 54 includes a first lateral side 58, a second lateral side 62 opposite the first lateral side 58, a front side 66 extending between the lateral sides 58, 62, and a rear side 68 opposite the front side 66. At least a portion of the bottom portion 54 abuts the toilet bowl when the base 30 is affixed to the toilet bowl. In particular, the bottom portion 54 includes a skirt 70 that defines the sides 58, 62, 66, 68. In other words, the skirt 70 forms a periphery of the bottom portion 54 of the base 30. The illustrated skirt 70 extends around an entire periphery of the bottom portion 54 of the base 30. The illustrated skirt 70 is also continuous and does not include any breaks or gaps. The skirt 70 may be a resilient skirt (e.g., resiliently deformable). The illustrated skirt 70 includes a bottom edge 72 that engages the toilet bowl. Moreover, the skirt 70 tapers from the bottom edge 72 toward the top portion 50. In other words, a footprint of the bottom portion 54 increases in a direction toward the toilet bowl. As best shown in FIG. 4, the skirt 70 forms a concave fillet. In other embodiments, the skirt 70 can be differently shaped and/or can be substantially rigid. For example, the skirt 70 can include planar or semi-planar surfaces extending from the top portion 50 toward the toilet bowl (e.g., at least one of the sides 58, 62, 66, 68 can be a planar or semi-planar surface). The skirt 70 of the illustrated embodiment is integrally formed as a single piece with the base 30 from the same material (e.g., via a single injection molding process). In such embodiments, the skirt 70 may be formed as a relatively thin wall such that the skirt 70 is flexible or deformable relative to the remainder of the base 30. In other embodiments, the skirt 70 can be formed from a different material than the base 30 and/or separately attached to the base 30. In the embodiment in which the skirt 70 is formed from a different material, the base 30 and the skirt 70 can be formed by a two-step process (e.g., a two-shot injection molding process).

With continued reference to FIGS. 4 and 5, the top portion 50 includes two recesses 74 adjacent the first side 58 and the second side 62, respectively. The base 30 also includes two elongated through holes 78 with each elongated through hole 78 extending through one of the recesses 74. Each elongated through hole 78 is sized to receive a shaft and a resilient bushing of a fastener 26, and each recess 74 is sized to receive a head of a fastener 26. Moreover, the recesses 74 include a bottom contoured surface (e.g., jagged surface) that engages with a lower contoured surface (e.g., jagged surface) of the heads of the fasteners 26 to hold a position of the fasteners 26 within the elongated through holes 78. The illustrated elongated through holes 78 allow for adjustment of the base 30 relative to the toilet bowl during installation of the base 30 on the toilet bowl (e.g., the fasteners 26 can move within the elongated through holes 78 to position the base 30 in a desired location on the toilet bowl before the fasteners 26 are secured to the toilet bowl).

In the illustrated embodiment, the top portion 50 of the base 30 further includes a plurality of projections 82, two of which contain the recesses 74. As best shown in FIG. 4, a channel 86 is positioned between adjacent projections 82. As best shown in FIG. 5, each projection 82 includes a slot 84 positioned at least partially around a periphery thereof (e.g., the projections 82 are not formed within the channels 86). In other embodiments, the recesses 74 containing the through holes 78 can be formed directly into a body of the base 30 without the use of projections. Furthermore, in the illustrated embodiment, the base 30 includes a plurality of recesses 90 (FIG. 5) corresponding to the plurality of projections 82 of the top portion 50. In some embodiments, the bottom portion 54 of the base 30 includes ribs 94, and the ribs 94, recesses 90, and the projections 82 at least partially act to increase structural rigidity of the base 30.

Figure 6:
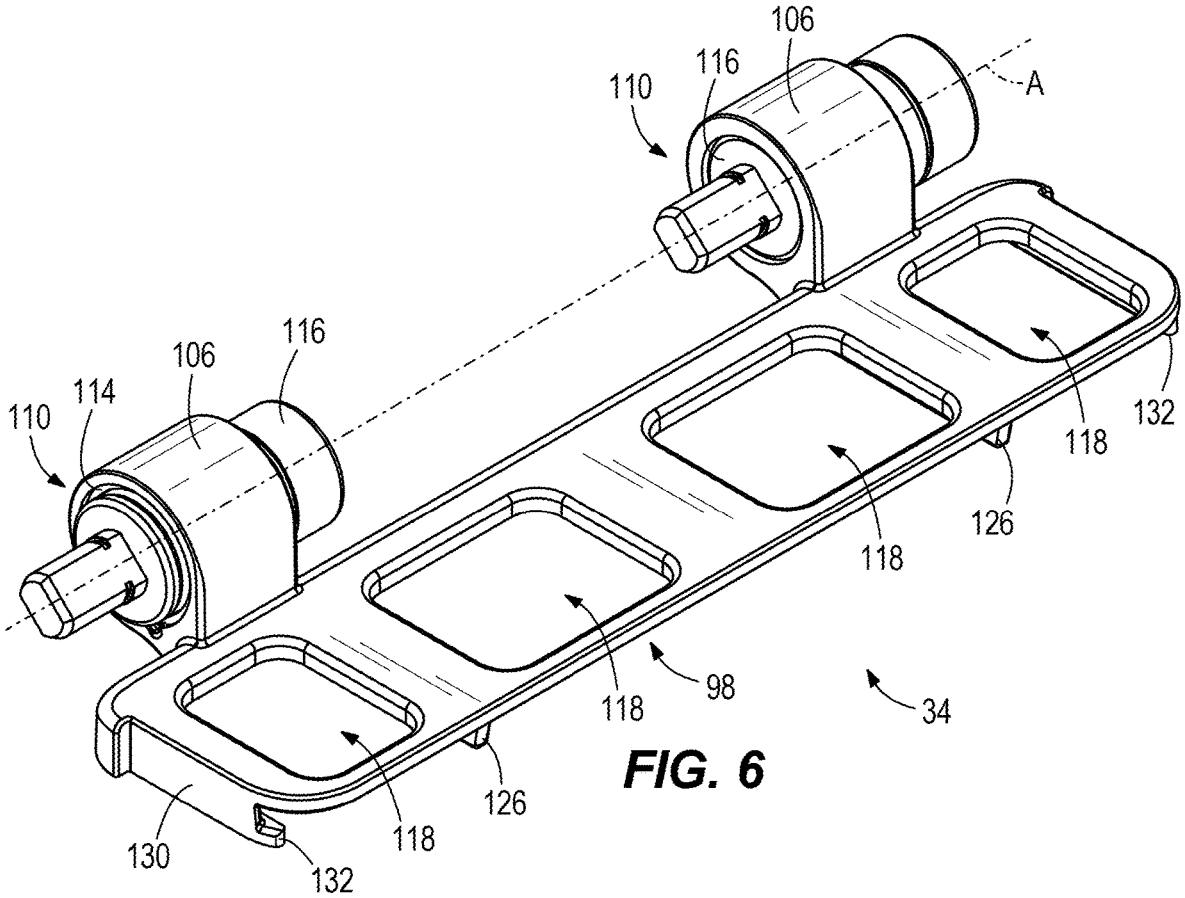
FIG. 6 is a top perspective view of a post of the toilet seat hinge shown in FIG. 1.
Figure 7:
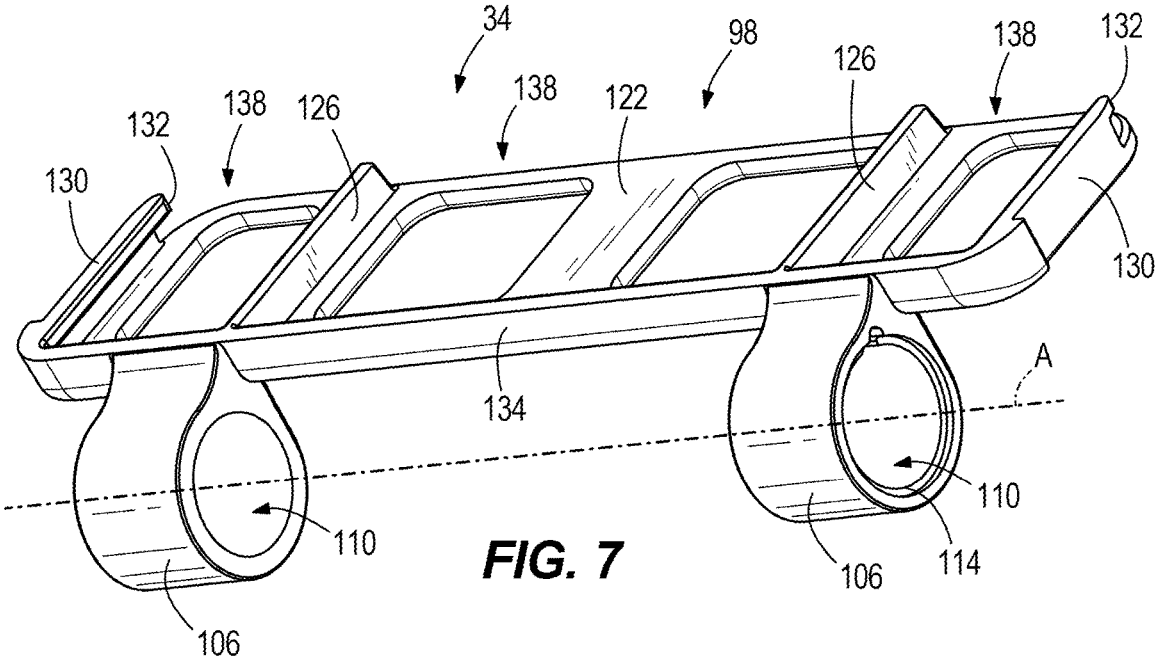
FIG. 7 is a bottom perspective view of the post shown in FIG. 6.

As shown in FIGS. 6 and 7, the post 34 includes a frame 98 and post rings 106. Each post ring 106 includes an opening 110 concentric with the pivot axis A. In addition, each post ring 106 includes a recess 114 on a lateral outward side of the post ring 106 that extends around the opening 110. In other embodiments, the recesses 114 can be formed on lateral inward sides of the post rings 106. Slow close dampers 116 are received within the openings 110 of the post rings 106. In particular, a middle portion of the slow close dampers 116 are rotatably fixed within the openings 110. In other embodiments, the post rings 106 may receive other members (e.g., fixed pins, etc.) to support the lid 14 and the seat 18 relative to the post 34. In further embodiments, the post 34 can be formed with the base 30 as a single integral component (e.g., via at least one injection molding process). In this embodiment, the integral post 34 and the base 30 can be referenced as the base of the hinge assembly 22.

With continued reference to FIGS. 6 and 7, the frame 98 of the post 34 includes a plurality of apertures 118 corresponding to the plurality of projections 82 of the of the base 30. The apertures 118 that correspond to the projections 82 containing the recesses 74 allow access to the fasteners 26 when the post 34 is installed on the base 30. Extending from a bottom side 122 of the frame 98 are a plurality of rails 126 that are received within the channels 86 between the projections 82 of the base 30 and oriented perpendicular to the pivot axis A. The frame 98 further includes two side members 130 and a cross member 134. The side members 130, the cross member 134, and the rails 126 collectively define openings 138 extending in a front-rear direction of the post 34, perpendicular to the pivot axis A. The openings 138 allow the post 34 to slide over the projections 82 and onto the base 30. In the illustrated embodiment, each side member 130 includes a lip 132 sized to engage portions of the slots 84 adjacent the lateral sides 58, 62 of the base 30.

Figure 8:
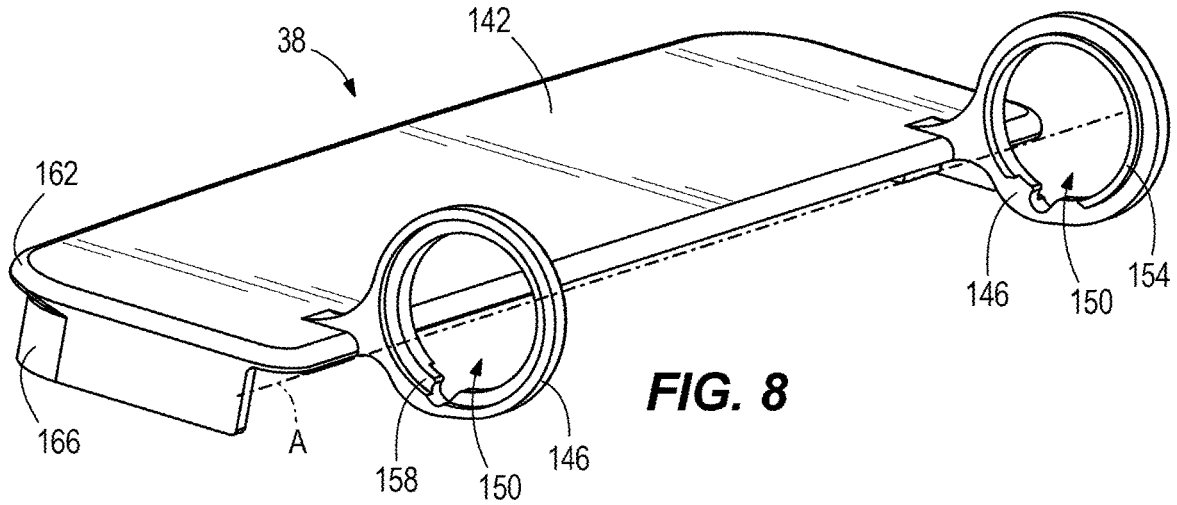
FIG. 8 is a top perspective view of a cap of the toilet seat hinge shown in FIG. 1.
Figure 9:
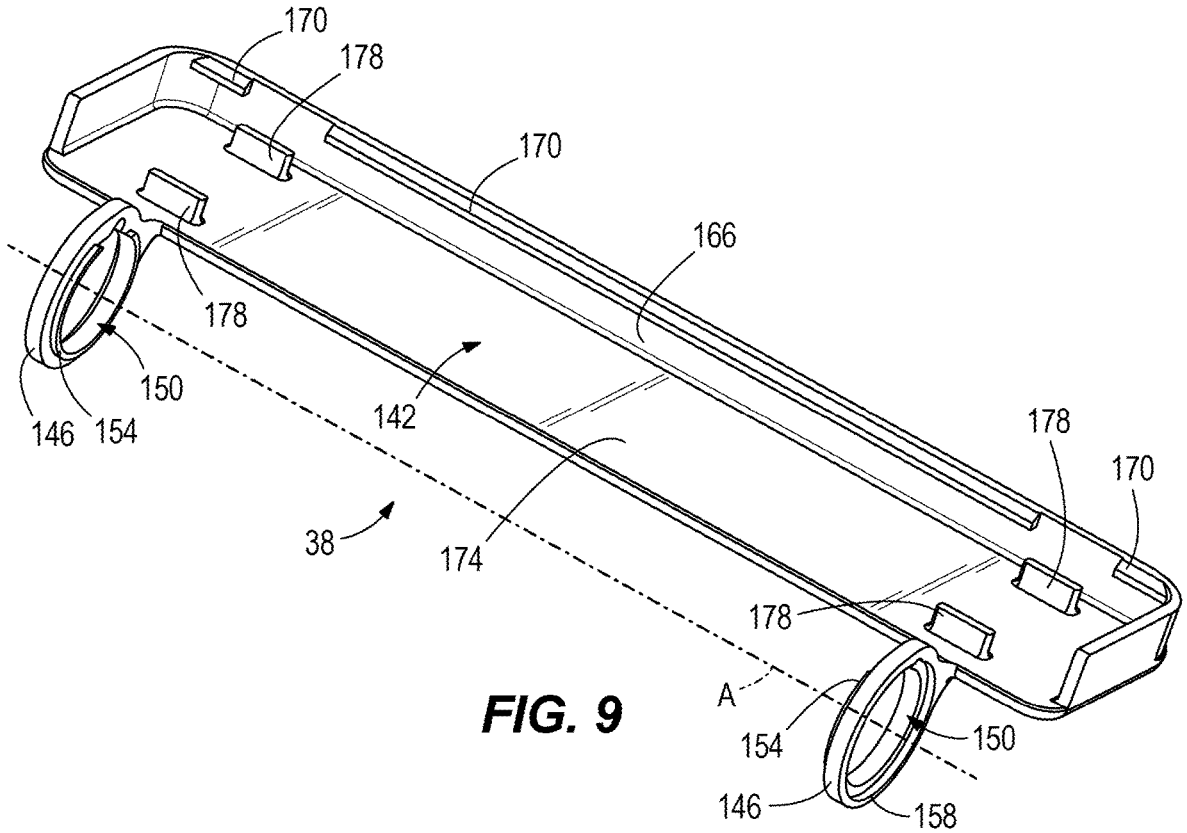
FIG. 9 is a bottom perspective view of the cap shown in FIG. 8.

As shown in FIGS. 8 and 9, the cap 38 includes a cover 142 and pivot portions 146 (e.g., pivot rings). Each pivot portion 146 includes an opening 150 that aligns with the openings 110 of the post rings 106. The pivot portions 146 are pivotably coupled to the slow close dampers 116 enabling the cap 38 to freely pivot about the pivot axis A. Furthermore, each pivot portion 146 includes an axially extending protrusion 154 on a lateral inner side and an axially extending recess 158 on a lateral outer side. The axially extending protrusions 154 and the axially extending recesses 158 extend around the openings 150. The axially extending protrusions 154 are received within the axial recesses 114 of the post ring 106 so that the pivot portions 146 and the post rings 106 overlap. In other embodiments, at least one protrusion 154 can be formed on the lateral outer side of at least one pivot portion 146 and/or at least one recess 158 can be formed on the lateral inner side of at least one pivot portion 146.

Figure 3:
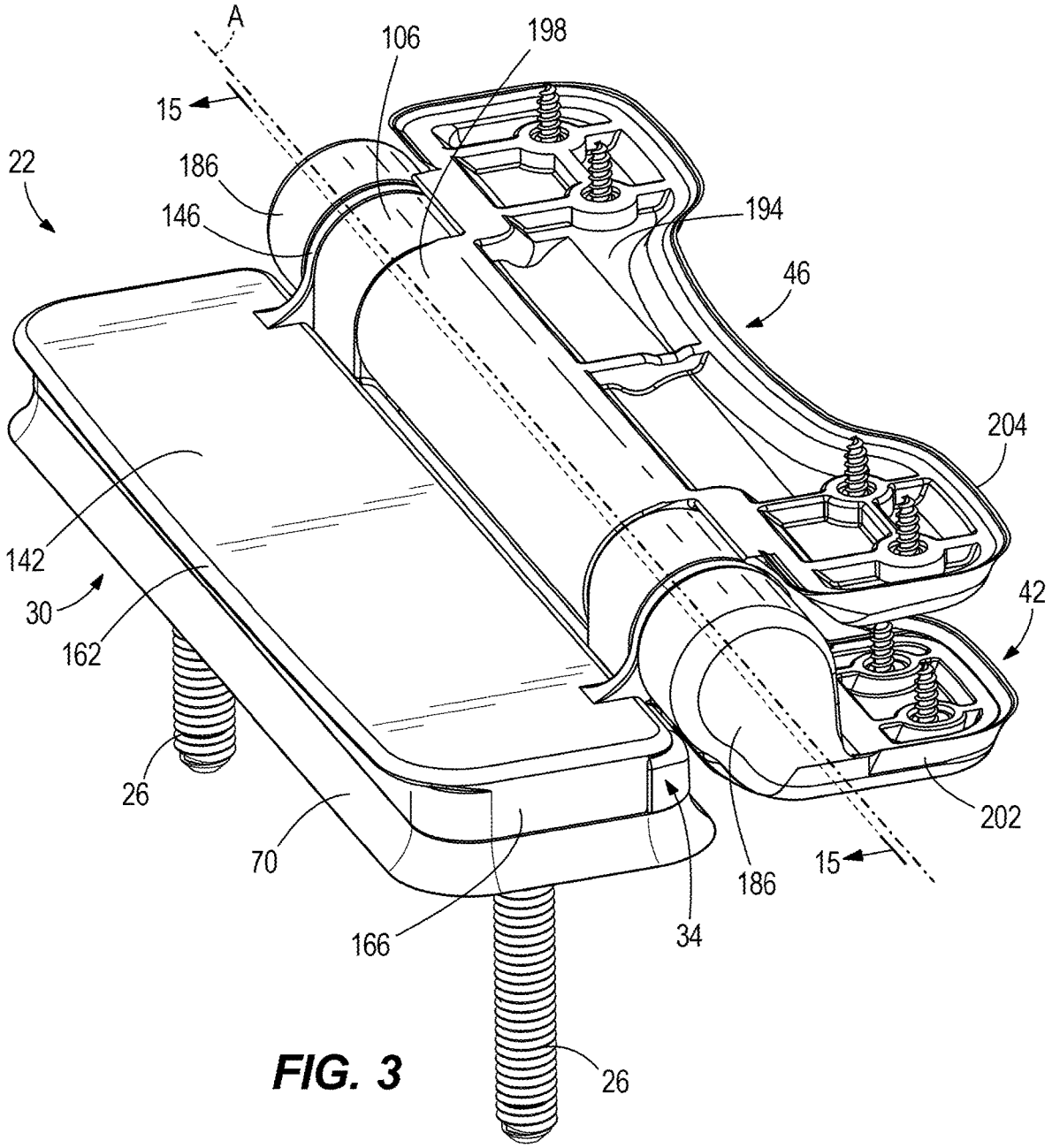
FIG. 3 is a top perspective view of the toilet seat hinge shown in FIG. 1.

As best shown in FIGS. 3 and 8, the cover 142 includes a grip portion 162, illustrated as a tab, extending from the cover 142. In other embodiments, the grip portion 162 may include other suitable structures that may be engaged by a user, such as one or more vertical or side projections, one or more recesses, and the like. With reference to FIGS. 8 and 9, the cover 142 further includes a wall 166 extending around three sides of the cover 142. In other embodiments, the wall 166 can extend from one side of the cover 142 (e.g., underneath the grip portion 162). The illustrated wall 166 includes a plurality of inwardly extending locking tabs 170. In other embodiments, the wall 166 can include a single locking tab 170. The illustrated cover 142 further includes a bottom surface 174 including protrusions 178 spaced from the wall 166. Each illustrated bottom surface protrusion 178 engages a surface that defines an aperture 118 of the post 34, and each inwardly extending locking tab 170 is selectively engageable with portions of the slots 84 adjacent the rear side 68 of the base 30. The illustrated cover 142 is rotatable about the pivot axis A between a locked position (FIG. 14), corresponding to the tabs 170 engaging corresponding slots 84 of the base 30, and an unlocked position (FIG. 13), in which the cover 142 is spaced from the base 30. The grip portion 162 is engageable by a user to pivot the cover 142 about the pivot axis A between the locked and unlocked positions.

Figure 10:
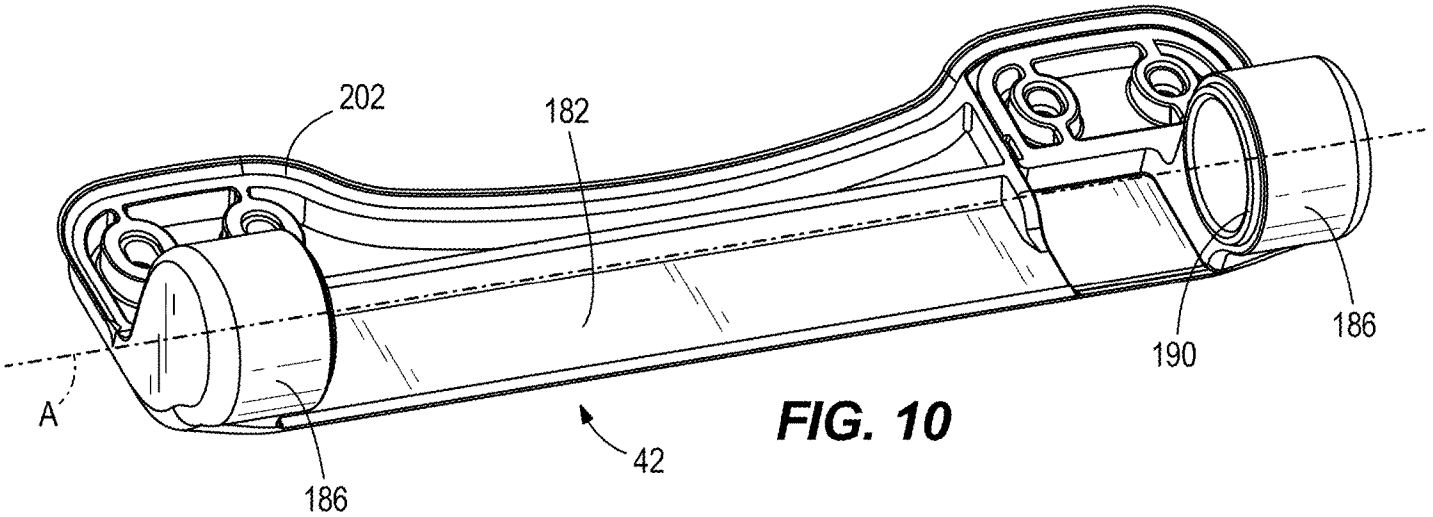
FIG. 10 is a perspective view of a toilet seat leaf of the toilet seat hinge shown in FIG. 1.
Figure 15:
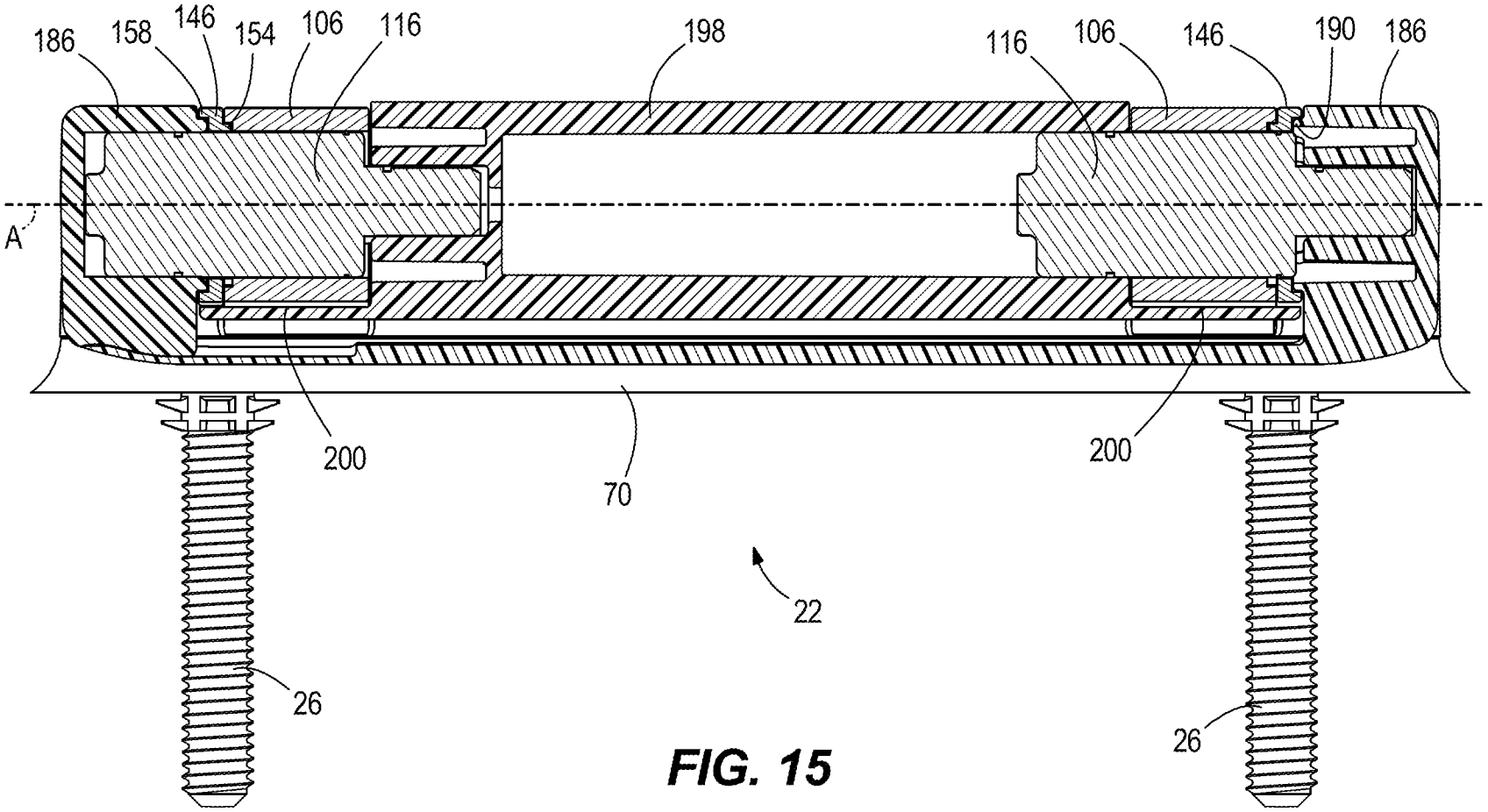
FIG. 15 is a cross-sectional view of the toilet seat hinge of FIG. 1 taken along section line 15-15 in FIG. 3.

As shown in FIG. 10, the toilet seat leaf 42 includes a body 182 secured to the seat 18 (e.g., via fasteners). The leaf 42 further includes two laterally opposed knuckles 186 (e.g., attachment portions) that receive outer end portions of the slow close dampers 116 (FIG. 15). In the illustrated embodiment, each knuckle 186 includes an axially extending protrusion 190 that is received within a corresponding axially extending recesses 158 of the cap 38. In other embodiments, at least one of the knuckles 186 can include a recess that receives a protrusion of one pivot portion 146. In yet other embodiments, the axially extending protrusions 190 of each knuckle 186 are receivable within the recesses 114 of the post rings 106 and form axial overlaps (e.g., along the pivot axis A) with the post rings 106. Therefore, a portion of each knuckle 186 is positioned radially inside of a portion of each post ring 106, or vice versa.

Figure 11:
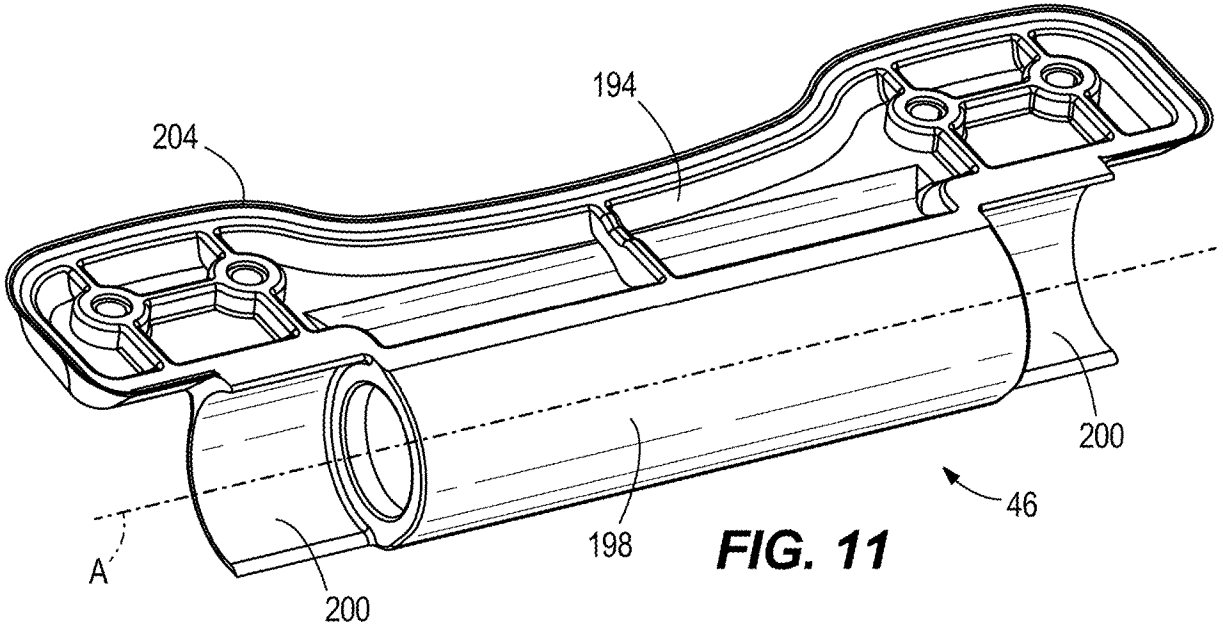
FIG. 11 is a perspective view of a toilet cover leaf of the toilet seat hinge shown in FIG. 1.

With reference to FIG. 11, the toilet cover leaf 46 includes a body 194 and a pivot sleeve 198. The pivot sleeve 198 is positioned between the post rings 106 of the post 34 to receive inner portions of the slow close dampers 116 (FIG. 15). The toilet cover leaf 46 further includes shields 200 disposed on both sides of the pivot sleeve 198. Each shield 200 extends outwardly along the pivot axis A to at least cover a portion (e.g., the protrusion 154) of the corresponding pivot portion 146 of the cap 38. In other words, each shield 200 extends over a gap formed between a post ring 106 and an adjacent pivot portion 146 in a direction along the pivot axis A. In other embodiments, the shields 200 of the toilet cover leaf 46 can be omitted, and the toilet cover leaf 46 and ring posts 106 of the post 34 can include a protrusion and recess arrangement (similar to toilet seat leaf 42 and the cap 38).

With continued reference to FIGS. 10 and 11, the toilet cover leaf 46 and the toilet seat leaf 42 further include skirts 202, 204, similar to the skirt 70 of the base 30. Each skirt 202, 204 may be a resilient skirt. The skirts 202, 204 form peripheries of the bodies 182, 194, respectively. The illustrated skirts 202, 204 extend continuously around at least three sides of the bodies 182, 194. In particular, the skirts 202, 204 extend around the sides of the bodies 182, 194 that are exposed or visible to a user during normal use of the toilet seat assembly 10. Similar to the skirt 70 of the base 30, the skirts 202, 204 of the illustrated embodiment are formed as concave fillets. In other embodiments, the skirts 202, 204 can be differently shaped and/or can be substantially rigid. In further embodiments, the body 182 of the toilet seat leaf 42 can be formed as two distinct bodies each including one knuckle 186 and/or the body 194 of the toilet cover leaf 46 can be formed as two distinct bodies each including a portion of the pivot sleeve 198 and a shield 200.

During assembly of the toilet seat 18 and the toilet seat leaf 42, the fasteners are tightened to compress the resilient skirt 202 against a bottom surface of the toilet seat 18. In the illustrated embodiment, the engagement between the skirt 202 and the bottom surface of the toilet seat 18 forms a seal to liquid or debris from entering underneath the leaf 42. The tapered skirt 202 provides a smooth transition between the body 182 and the bottom surface of the toilet seat 18 to aid in quicker and more effective cleaning around the leaf 42 than conventional designs. In conventional designs, a leaf of a toilet seat hinge forms a substantially perpendicular wall (e.g., a sharp edge) with the bottom surface of the toilet seat 18 that allows debris to easily collect at the interface between the leaf and the bottom surface. Moreover, once debris is collected at the interface between a conventional leaf and the toilet seat, it is difficult to clean and remove the debris (e.g., by using a cleaning rag around the periphery of the leaf). However, in the illustrated embodiment, the smooth transition between the skirt 202 and the bottom surface of the toilet seat 18 inhibits debris from being collected between the leaf 42 and the toilet seat 18. In addition, cleaning around the illustrated leaf 42 can be simply carried out by using, for example, a rag around the interface between the skirt 202 and the toilet seat 18.

The skirt 204 of the toilet cover leaf 46 functions in a similar manner to the skirt 202 of the toilet seat leaf 42. For example, during assembly of the toilet cover 14 and the toilet cover leaf 46, the fasteners are tightened to compress the resilient skirt 204 against a bottom surface of the toilet cover 14. The tapered skirt 204 provides a smooth transition between the body 194 and the bottom surface of the toilet cover 14 to aid in quicker and more effective cleaning around the leaf 46 than conventional designs. In the illustrated embodiment, the engagement between the skirt 204 and the bottom surface of the toilet cover 14 forms a seal to inhibit liquid or debris from entering underneath the leaf 46.

To secure the base 30 to the toilet bowl, the base 30 is placed on an upper surface of the toilet bowl such that the elongated through holes 78 align with securement holes of the toilet bowl. The fasteners 26 are then inserted through the through holes 78 and the securement holes and secured to the toilet bowl (e.g., via shear nuts). As the fasteners 26 are tightened, the bottom portion 54 of the base 30 is drawn closer to the toilet bowl, thereby compressing the skirt 70 against the upper surface of the toilet bowl. In some instances, the upper surface of the toilet bowl is not completely flat where the base 30 is installed, but rather, the upper surface of the toilet bowl can be a slightly curved upper surface (e.g., concave, convex, or both). Accordingly, compression of the resilient skirt 70 against the slightly curved upper surface allows the base 30 to engage the slightly curved upper surface of the toilet bowl about the entire perimeter of the base 30. In other words, the resilient skirt 70 inhibits gaps from forming between the base 30 and the toilet bowl due to the slightly curved upper surface of the toilet bowl. In the illustrated embodiment, the engagement between the skirt 70 and the slightly curved upper surface of the toilet bowl forms a seal to inhibit liquid or debris from entering underneath the base 30.

Furthermore, the tapered design of the skirt 70 creates a smooth transition from the base 30 to the upper surface of the toilet bowl to aid in quicker and more effective cleaning around the base 30 than conventional designs. In conventional designs, a base of a toilet seat hinge forms a substantially perpendicular wall (e.g., a sharp edge) with the upper surface of the toilet bowl that allows debris to easily collect at the interface between the base and the upper surface. Moreover, once debris is collected at the interface between a conventional base and the toilet bowl, it is difficult to clean and remove the debris (e.g., by using a cleaning rag around the periphery of the base). However, in the illustrated embodiment, the smooth transition between the base 30 and the upper surface of the toilet bowl inhibits debris from being collected between the base 30 and the toilet bowl. In addition, cleaning around the illustrated base 30 can be simply carried out by using, for example, a rag around the interface between the skirt 70 and the toilet bowl.

Figure 12:
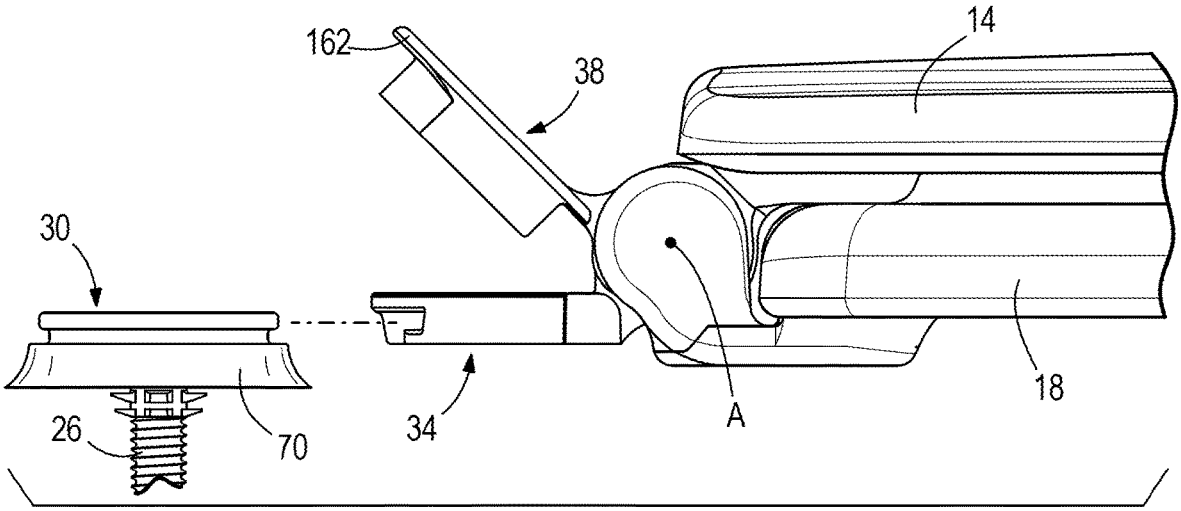
FIG. 12 is a side view of the toilet seat assembly of FIG. 1, illustrating a toilet seat and a toilet seat cover disconnected from the base.
Figure 13:
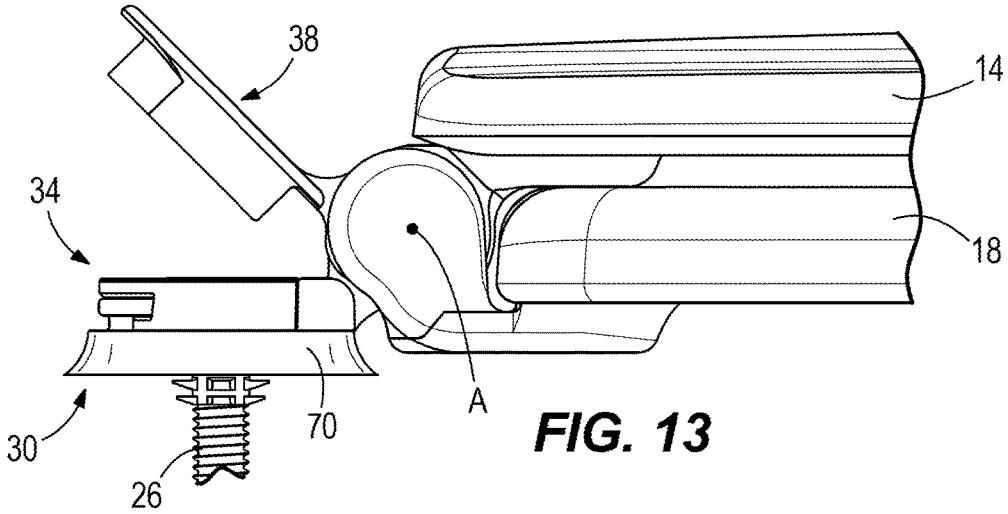
FIG. 13 is a side view of the toilet seat assembly of FIG. 1, illustrating the toilet seat and the toilet seat cover connected to the base with the cap in an unlocked position.
Figure 14:
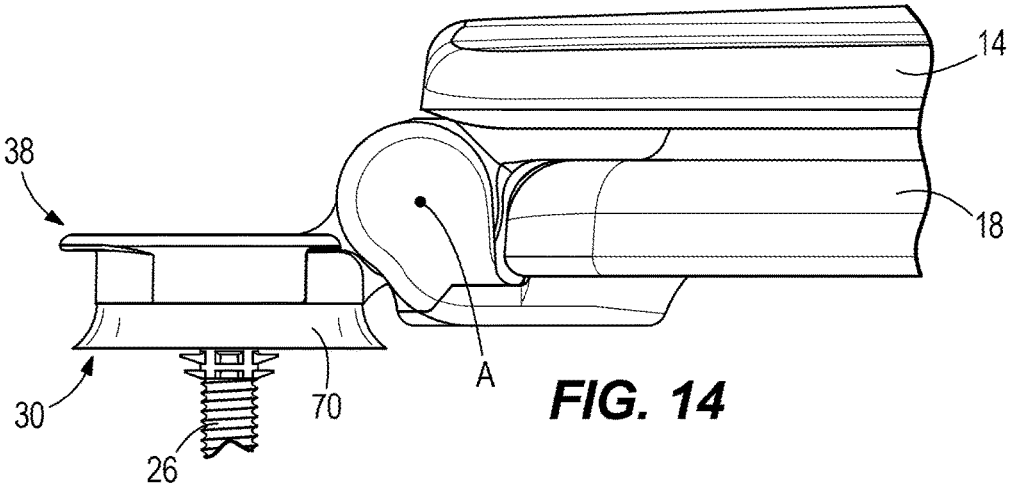
FIG. 14 is a side view of the toilet seat assembly of FIG. 1, illustrating the toilet seat and the toilet seat cover connected to the base with the cap in a locked position.

With reference to FIGS. 12-14, steps of securing the toilet cover 14 and the toilet seat 18 to the fastened base 30 are illustrated. For example, the post 34 is slid onto the base 30 in a direction substantially parallel to the upper surface of the toilet bowl. In particular, the lips 132 and the rails 126 of the post 34 are aligned with and engage the slots 84 and channels 86 of the base 30, respectively, to guide the sliding movement of the post 34 onto the base 30. The post 34 is slid onto the base 30 until the cross member 134 engages the projections 82 of the base 30. The cap 38 is then rotated from the unlocked position (FIG. 13) to the locked position (FIG. 14), such that the locking tabs 170 of the cap 38 engage the slots 84 of the base 30. Accordingly, the toilet seat cover 14 and the toilet seat 18 are secured to the base 30 and can pivot about the axis A during use of the toilet seat assembly 10.

Figure 16:
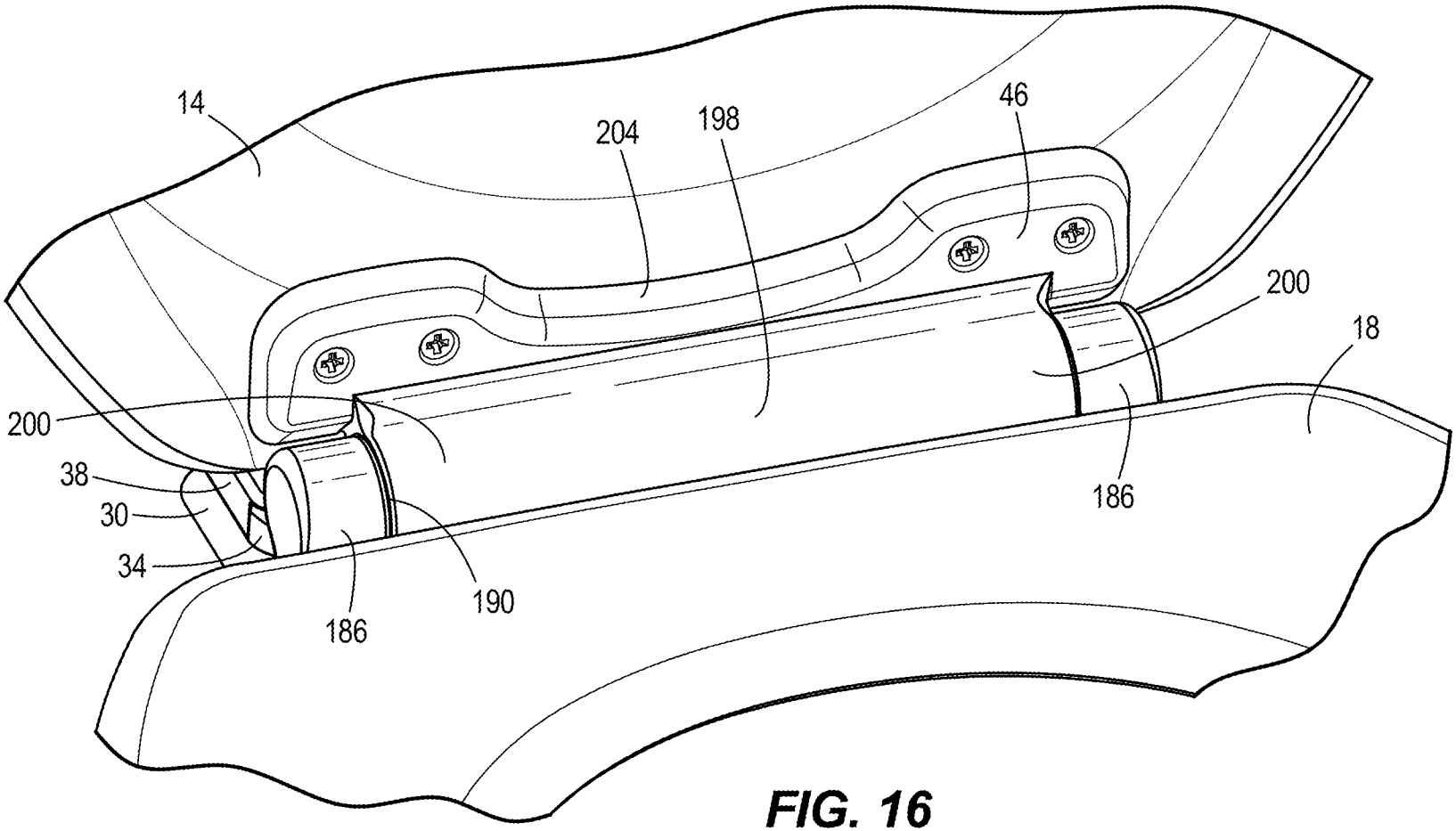
FIG. 16 is a perspective view of the toilet seat assembly of FIG. 1, illustrating the toilet seat cover in a raised position and the toilet seat in a lowered position.

Moreover, during use of the toilet seat assembly 10, the toilet seat 18 can be positioned in a lowered position and the toilet seat cover 14 can be positioned in a raised position (FIG. 16). In this configuration, the toilet seat hinge 22 is designed to substantially eliminate the user's line of sight to the base 30, the post 34, and the cap 38. For example, the shields 200 of the toilet cover leaf 46 block the user from seeing the gaps formed between the post rings 106 and the pivot portions 146 of the cap 38. In addition, the protrusions 190 of the toilet seat leaf 42 that are received within the recesses 158 of the pivot portions 146 are only visible to the user between the shields 200 and the knuckles 186. Accordingly, the shields 200 and the protrusions 190 block the user's sight to the base 30, the post 34, and the cap 38 to provide a more visually appealing hinge 22 than a conventional hinge in which a user can see through gaps formed between, for example, a toilet seat leaf and a locking cap and/or the locking cap and a toilet cover leaf. The overlap of the protrusions 190 and the recesses 158 also inhibits liquids and debris from entering between the toilet seat leaf 42 and the pivot portions 146.

To remove the toilet seat cover 14 and the toilet seat 18 from the base 30 (e.g., to facilitate cleaning of the toilet seat assembly 10), the cap 38 is rotated about the axis A to the unlocked position (FIG. 13). The post 34 can then be removed from the base 30 (FIG. 12).

Figure 17:
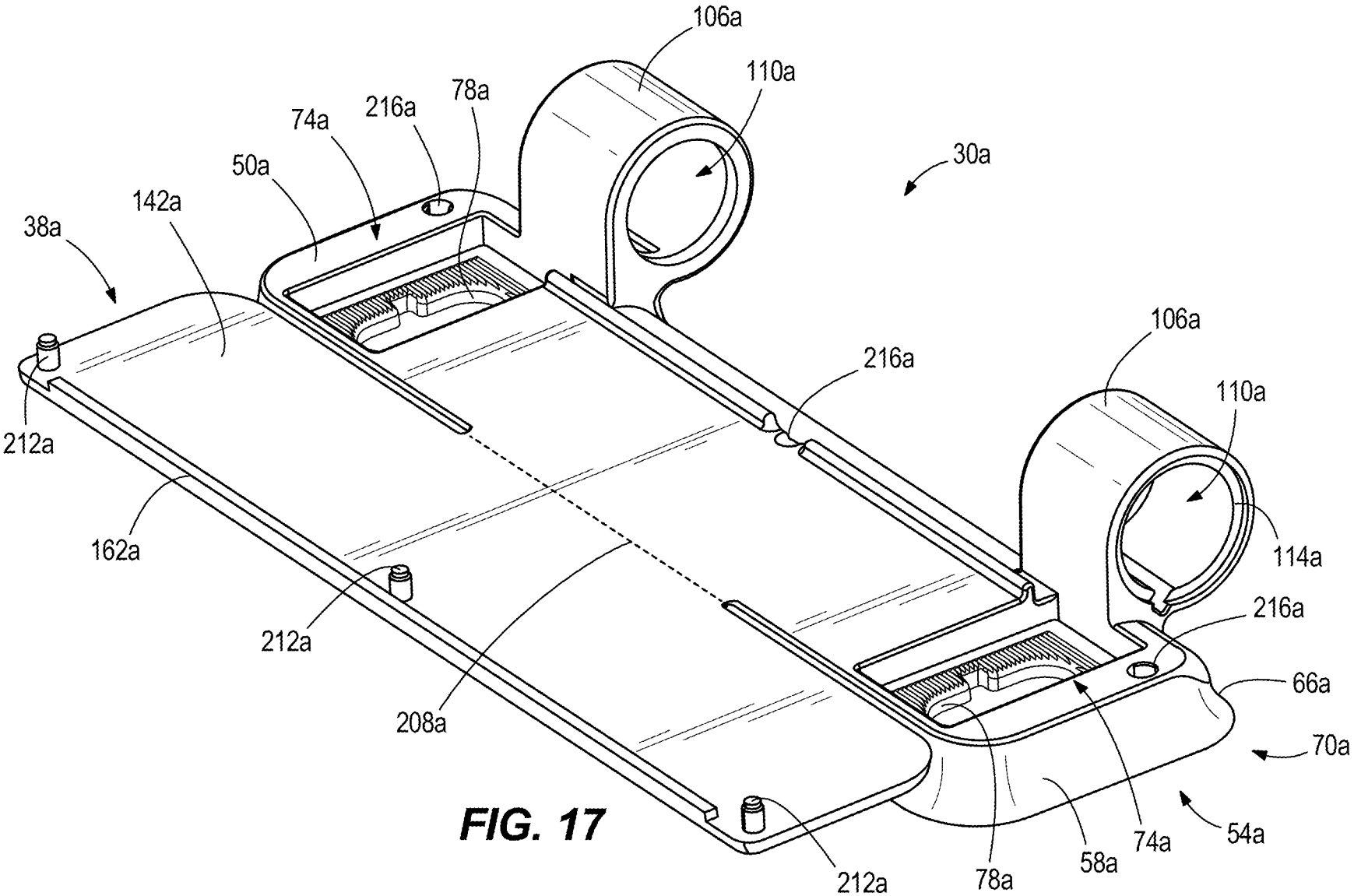
FIG. 17 is a perspective view of a toilet seat hinge embodying another embodiment of the disclosure.
Figure 18:
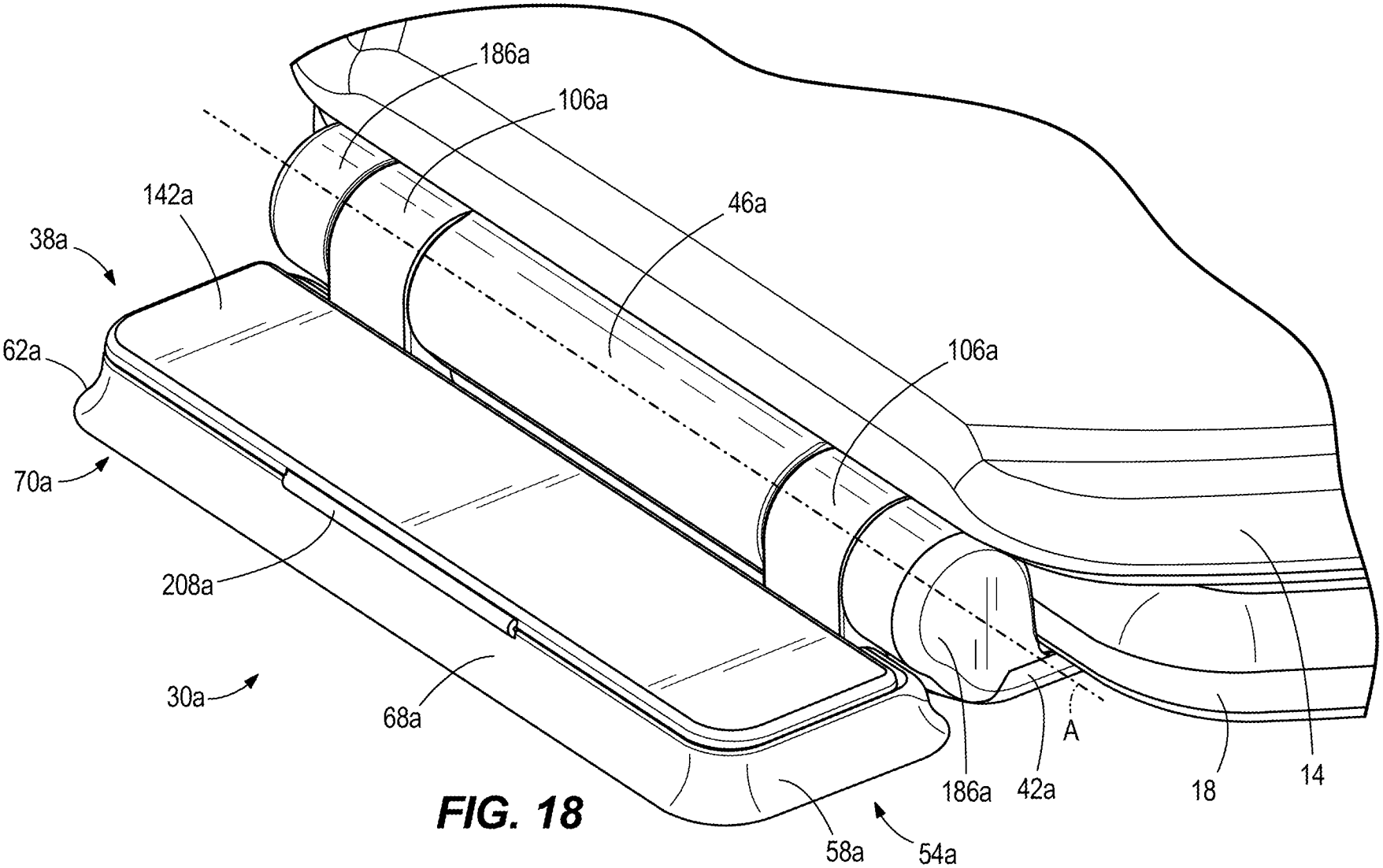
FIG. 18 is a perspective view of the toilet seat hinge of FIG. 17 coupled to a toilet seat and a toilet seat cover.

FIGS. 17 and 18 illustrate a toilet seat hinge 22*a* according to another embodiment. The toilet seat hinge 22*a* is similar to the toilet seat hinge 22; therefore, similar components are designated with similar references numbers including the letter "a." At least some differences and/or at least some similarities between the toilet seat hinges 22, 22*a* will be discussed in detail below. In addition, components or features described with respect to the toilet seat hinge 22*a* are equally applicable to the toilet seat hinge 22.

The illustrated toilet seat hinge 22*a* includes a base 30*a* that abuts and is fixed to the toilet bowl via the fasteners 26. The base 30*a* includes a top surface 50*a* and a bottom portion 54*a*. The bottom portion 54*a* includes a first lateral side 58*a*, a second lateral side 62*a*, a front side 66*a*, and a rear side 68*a*. The bottom portion 54*a* also includes a skirt 70*a* that defines the sides 58*a*, 62*a*, 66*a*, 68*a*. In addition, elongated through holes 78*a* extend through recesses 74*a* formed in the top surface 50*a*. The base 30*a* also includes post rings 106*a* (e.g., upright portions) each including an opening 110*a* and a recess 114*a*.

The illustrated base 30*a* further includes a cap 38*a* coupled to the upper portion 50*a* by at least one living hinge 208*a*. In particular, the living hinge 208*a* is coupled to the base 30*a* adjacent the rear side 68*a* such that the cap 38*a* is moveable about an axis defined by the living hinge 208*a* between an open position (FIG. 17) and a closed position (FIG. 18). The illustrated cap 38*a* includes a tab 162*a* and protrusions 212*a* extending from a cover 142*a* of the cap 38*a*. The protrusions 212*a* are received within apertures 216*a* formed in the top surface 50*a* of the base 30*a* and the tab 162*a* engages a portion of the base 30*a* when the cap 38*a* is in the closed position to hold the cap 38*a* in the closed position. In the closed position, the cap 38*a* at least covers the recesses 74*a*—and ultimately the fasteners 26. In other embodiments, the at least one living hinge 208*a* can be formed at a different location on the base 30*a* (e.g., adjacent the front side 66*a*, the first lateral side 58*a*, the second lateral side 62*a*, etc.). In further embodiments, the cap 38*a* can be formed as a plurality of caps each including a living hinge (e.g., the plurality of caps can be independently moveable relative to the base 30*a*). In yet further embodiments, the base 30*a* can be formed as two separate bases with each base including one cap 38*a* having a living hinge. In addition, in other embodiments, the living hinge 208*a* can be omitted and replaced with pivot rings (e.g., similar to the pivot rings 146) for the cap 38*a* to pivot about the pivot axis A or a different axis of the hinge 22*a*.

In the illustrated embodiment, the base 30*a* and the cap 38*a* are formed as a single integral component from a single injection molding process. In other embodiments, the base 30*a* and the cap 38*a* can be formed from a plurality of injection molding processes (e.g., the cap 38*a*, the skirt 70*a*, and/or the post rings 106*a* can be formed by different injection molding processes).

With reference to FIGS. 18, the toilet seat hinge 22*a* includes a toilet seat leaf 42*a* coupled to the toilet seat 18. The toilet seat leaf 42*a* is pivotably coupled to the post rings 106*a* about the pivot axis A. The toilet seat leaf 42*a* includes knuckles 186*a* each including axially extending protrusions (e.g., similar to the protrusions 190) that are received within the recesses 114*a* of the post rings 106*a*. In addition, the toilet seat leaf 42*a* can include a skirt similar to the skirt 202 (FIG. 10).

With continued reference to FIG. 18, the toilet seat hinge 22*a* also includes a toilet cover leaf 46*a* coupled to the toilet seat cover 14. The toilet cover leaf 46*a* is pivotably coupled to the post rings 106*a* about the pivot axis A. In addition, the toilet cover leaf 46*a* can include a skirt and shields similar to the skirt 204 and the shields 200 (FIG. 11).

To assemble the toilet seat hinge 22*a* to the toilet bowl, the base 30*a* is positioned such that the fasteners 26 can be inserted through the through holes 78*a* of the base 30*a* to be fastened to the toilet bowl. The cover 142*a* of the cap 38*a* can then be moved about the living hinge 208*a* from the open position (FIG. 17) to the closed position (FIG. 18) to cover the fasteners 26. To remove the toilet seat hinge 22*a* from the toilet bowl, the cover 142*a* is moved from the closed position to the open position to expose the fasteners 26. The fasteners 26 can then be loosened and removed from the toilet bowl and the hinge 22*a* to remove the hinge 22*a* from the toilet bowl. In other embodiments, the toilet seat hinge 22*a* remains coupled to the toilet bowl after installation (e.g., the toilet seat hinge 22*a* is not quickly removable relative to the toilet bowl as discussed above with respect to the toilet seat hinge 22).

Although the disclosure has been described in detail with reference to certain preferred embodiments, variations and modifications exist within the scope and spirit of one or more independent aspects of the disclosure as described.

Various features and advantages of the disclosure are set forth in the following claims.

What is claimed is:

1. A hinge assembly configured to pivotably couple a toilet seat to a toilet bowl about a pivot axis, the hinge assembly comprising:

a base configured to be selectively fixed to the toilet bowl, the base including a top portion, and a bottom portion opposite the top portion, the bottom portion having a flexible skirt that is configured to compress against the toilet bowl when the base is fixed to the toilet bowl to inhibit liquid from entering between the base and the toilet bowl; and a post coupled to the base, the post configured to support the toilet seat for rotation about the pivot axis.

2. The hinge assembly of claim 1, wherein the skirt tapers from the bottom portion toward the top portion, such that a footprint of the bottom portion increases in a direction from the top portion toward the toilet bowl.

3. The hinge assembly of claim 1, wherein the skirt forms a concave fillet.

4. The hinge assembly of claim 1, wherein the skirt is formed of a resiliently deformable material.

5. The hinge assembly of claim 4, wherein the skirt is formed of a same material as a remainder of the base.

6. The hinge assembly of claim 4, wherein, when the base is fixed to the toilet bowl, the skirt deforms to increase a footprint of the base.

7. The hinge assembly of claim 1, wherein the skirt extends around an entire periphery of the base.

8. A hinge assembly configured to pivotably couple a toilet seat to a toilet bowl about a pivot axis, the hinge assembly comprising:

a base configured to be selectively fixed to the toilet bowl;

a post coupled to the base; and a toilet seat leaf pivotably coupled to the post about the pivot axis and configured to be attached to the toilet seat, the toilet seat leaf having a skirt that is configured to engage the toilet seat to inhibit liquid from entering between the toilet seat leaf and the toilet seat, the skirt being compressed against the toilet seat when the toilet seat leaf is being attached to the toilet seat.

9. The hinge assembly of claim 8, wherein the skirt forms a concave fillet.

10. The hinge assembly of claim 8, wherein the skirt is formed of a resiliently deformable material.

11. The hinge assembly of claim 8, wherein, when the toilet seat leaf is attached to the toilet seat, the skirt deforms to increase a footprint of the toilet seat leaf.

12. The hinge assembly of claim 8, wherein the skirt extends around at least three sides of the toilet seat leaf.

13. The hinge assembly of claim 8, further comprising a toilet cover leaf pivotably coupled to the post about the pivot axis and configured to be attached to a toilet cover, wherein the toilet cover leaf has a skirt hat is configured to engage the toilet cover to inhibit liquid from entering between the toilet cover leaf and the toilet cover.

14. A hinge assembly configured to pivotably couple a toilet seat to a toilet bowl about a pivot axis, the hinge assembly comprising:

a base configured to be selectively fixed to the toilet bowl;

a post coupled to the base and including a post ring; and a toilet seat leaf including a body configured to be coupled to the toilet seat and a knuckle coupled to the post for rotation about the pivot axis, wherein an axial overlap is formed between the post ring and the knuckle in a direction parallel to the pivot axis.

15. The hinge assembly of claim 14, wherein a portion of the knuckle overlaps a portion of the post ring to form the axial overlap directly between the knuckle and the post ring.

16. The hinge assembly of claim 14, further comprising a cap pivotably coupled to the base, wherein the cap includes a pivot ring positioned between the knuckle and the post ring, and wherein the pivot ring forms the axial overlap with the post ring, the knuckle, or both.

17. The hinge assembly of claim 14, wherein the knuckle includes an axially extending protrusion that is received in an axial extending recess to at least partially form the axial overlap.

18. The hinge assembly of claim 14, further comprising a slow close damper supported by the base and defining the pivot axis, wherein the knuckle and the post ring are coupled to the slow close damper.

19. The hinge assembly of claim 14, further comprising a toilet cover leaf coupled to the base and configured to support a toilet cover for rotation about the pivot axis, the toilet cover leaf including a pivot sleeve adjacent the post ring.

20. The hinge assembly of claim 19, wherein the pivot sleeve includes a shield extending axially from an end of the pivot sleeve, and wherein the shield is positioned radially outside of the post ring and over a gap between the post ring and the pivot sleeve.

* * * * *